US006170181B1

(12) United States Patent
Gröner

(10) Patent No.: US 6,170,181 B1
(45) Date of Patent: Jan. 9, 2001

(54) NAME TAG HAVING A VIEWING WINDOW AND A FASTENING CLIP

(75) Inventor: Dieter Gröner, Constance (DE)

(73) Assignee: Stoba AG, Horn (CH)

( * ) Notice: Under 35 U.S.C. 154(b), the term of this patent shall be extended for 0 days.

(21) Appl. No.: 09/250,607

(22) Filed: Feb. 17, 1999

(30) Foreign Application Priority Data

Feb. 17, 1998 (EP) ..... 98102711

(51) Int. Cl.[7] ..... A44C 3/00
(52) U.S. Cl. ..... 40/1.6; 40/666; 24/3.12
(58) Field of Search ..... 40/1.5, 1.6, 661.04, 40/666; 24/3.12, 3.11, 563, 614; 63/20

(56) References Cited

U.S. PATENT DOCUMENTS 3,810,321 * 5/1974 Kiba ..... 40/1.5
4,100,653 * 7/1978 Sensabaugh ..... 24/3.11
4,989,352 * 2/1991 Seppanen ..... 40/1.5
5,613,602 * 3/1997 Lage et al. ..... 40/666 X
5,664,292 * 9/1997 Chen ..... 24/3.11

FOREIGN PATENT DOCUMENTS 8901912 7/1989 (DE) .
4226341A1 2/1994 (DE) .
0554073A1 8/1993 (EP) .

* cited by examiner

*Primary Examiner*—Brian K. Green
(74) *Attorney, Agent, or Firm*—Evenson, McKeown, Edwards & Lenahan, P.L.L.C.

(57) ABSTRACT

A name tag includes a fastening clip on a rear wall which can be displaced in two mutually crossing guide grooves into different end positions. Swivelling can take place only at the crossing point, in which case, also at the crossing point, the foot part and its slide can be secured in the respective groove against falling out. The fastening clip can be moved into different positions with a clip opening which, in each case, points in a different direction. The clip can be secured in these positions against unintentional displacement and swivelling.

20 Claims, 8 Drawing Sheets

NAME TAG HAVING A VIEWING WINDOW AND A FASTENING CLIP

This application claims the priority of European patent application No. 98 102 711.3, filed Feb. 17, 1998, the disclosure of which is expressly incorporated by reference herein.

BACKGROUND OF THE INVENTION

The present invention relates to a name tag with a viewing window in the front wall and a fastening clip on the rear wall, the clip having a resilient contact pressure leg and an adjoining foot part which is swivellably mounted on the rear wall.

In currently known, commercially available name tags of the above-mentioned type, the foot part of the fastening clip is usually swivellably mounted on the tag by a rivet, which makes it possible to direct the clip in any direction; this allows clip opening to the left, to the right, at the top or at the bottom.

This permits various ways of attaching the name tag to pieces of clothing, handbags, etc. It is a disadvantage of this construction that, even when the rivet head has a relatively close contact, the name tag may unintentionally be tilted, which at least aesthetically creates an unpleasant appearance.

SUMMARY OF THE INVENTION

It is an object of the present invention to mount a swivellable fastening clip on a tag in such a manner that the tag cannot unintentionally be swivelled and without requiring unacceptably high manufacturing costs.

In a name tag of the type mentioned above, this object is achieved according to the invention by providing the foot part of the tag with a slide and a rear wall of the tag with a first guide groove extending in the transverse direction of the tag. A second guide groove branches off the first guide groove at a right angle. The guide grooves are constructed in this manner for securing the slide against falling out and securing the foot part against a lateral swinging out of the respective groove axis. Swivelling of the foot part and thus of the clip by at least 90° at the crossing point of the two guide grooves is permitted.

Particular embodiments of the name tag according to the invention are reflected in the various claims.

The mutually crossing guide grooves permit swivelling at a crossing point but secure the slide of the base part with respect to falling out and lateral swinging out. As a result, the fastening clip can be brought into any desired position, and in the respective end position (operative position), swivelling is no longer possible.

BRIEF DESCRIPTION OF THE DRAWINGS

The invention will be explained in more detail in the following by way of two embodiments illustrated in the drawings.

DESCRIPTION OF THE PREFERRED EMBODIMENTS

Figure 3:
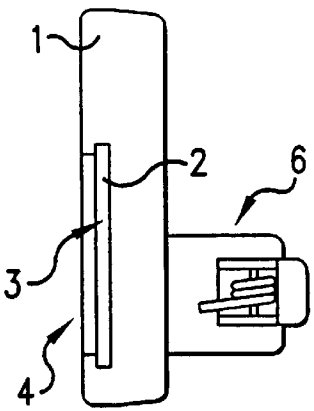
FIG. 3 is a lateral view of the tag according to FIG. 2.
Figure 1:
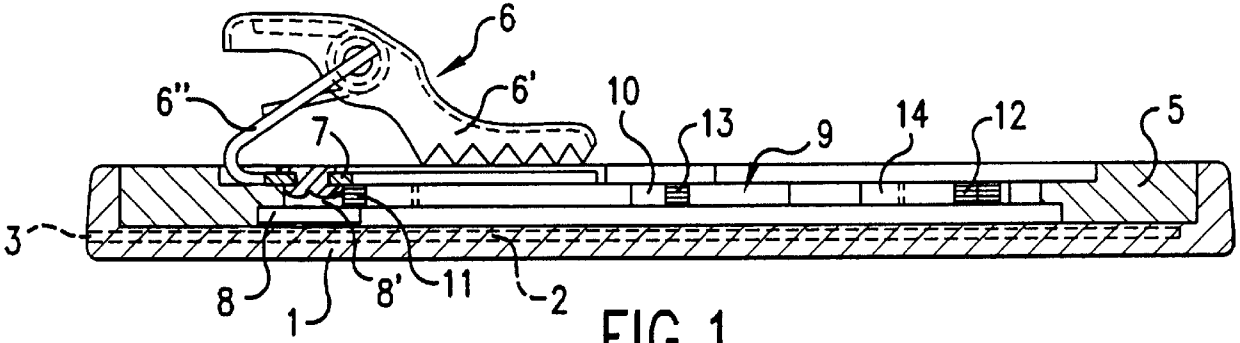
FIG. 1 is a sectional view of a name tag according to the invention with a clip opening "pointing" or oriented to the right.
Figure 2:
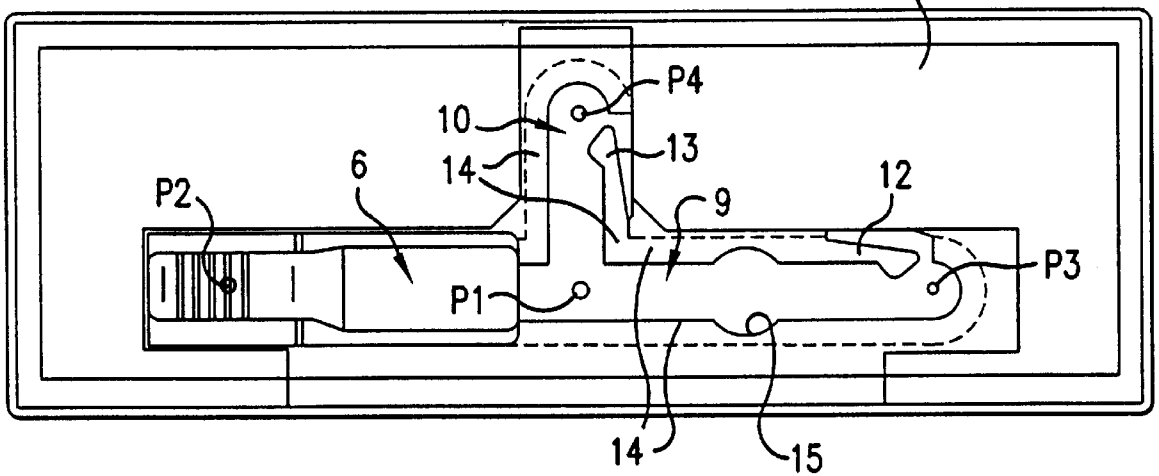
FIG. 2 is a top view of the back side of the tag shown in FIG. 1.

FIGS. 1 to 7 illustrate a first variant of a name tag according to the present invention. As illustrated in FIGS. 1 to 3, a slot 2 with a lateral opening 3 for sliding in a name carrier (not shown) is provided in the front wall 1. This name carrier is visible through a window 4.

On the rear wall 5, a fastening clip 6 is provided which can be swivelled in a specific position so that the clip opening points to the right, left or downward.

The special characteristic of this construction is the fact that the foot part 7 can be displaced, by way of a pertaining slide 8, in a first guide groove 9, which extends transversely to the tag, and in a second groove 10, which branches off this first groove 9. The slide 8 is secured against both falling out and lateral swivelling. The foot part 7, and therefore the clip 6 as such, can be swivelled only at the crossing point P1 of the grooves 9, 10 in order to be brought into a different position. The slide 8 is also secured against falling out at the crossing point. The slide 8 and the foot part 7 are locked in the end points P2, P3 and P4. In the illustrated example, the slide and foot part are locked by resilient legs 11, 12 or 13, which keep the pin-shaped part 8' of the slide 8 locked in the corresponding end position against unintentional displacement.

The illustrated fastening clip 6 is a so-called alligator clip which is known per se and has resilient legs 6', 6".

As illustrated in the drawing, the grooves 9, 10 have inwardly projecting upper collars 14, behind which the slide 8 is caught. The resilient legs 11 to 13 form portions of these collars 14.

The specially worked-out grooves 9, 10 are provided in a rear wall 5 which is inserted into the front wall 1 (for example, by clipping or gluing).

The slide 8 can be placed, in position 15, for example, by pressing the slide in the groove of the rear wall 5, which is made of plastic.

Figure 6:
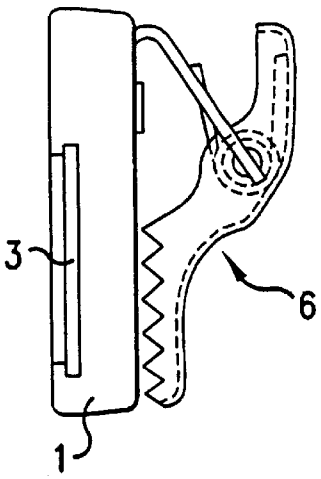
FIGS. 4 to 6 are views similar to those of FIGS. 1 to 3 with the clip in the fitted-in position and with the clip opening pointing downward.
Figure 4:
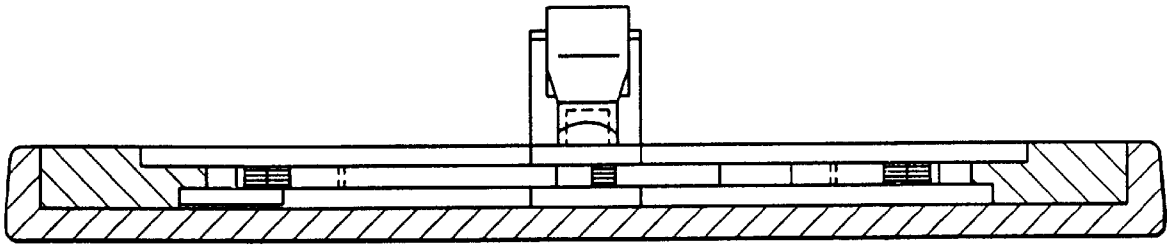
Figure 5:
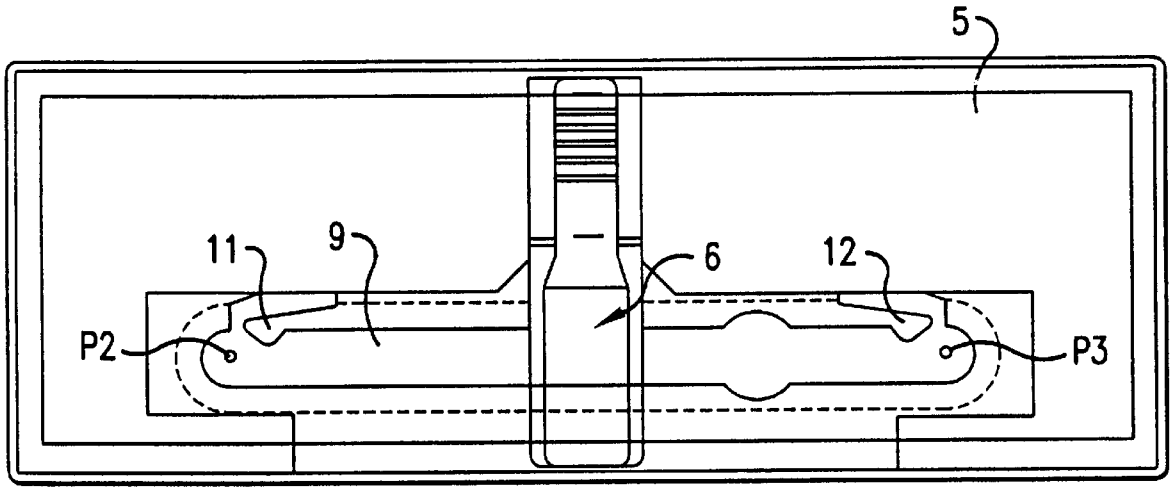
Figure 7:
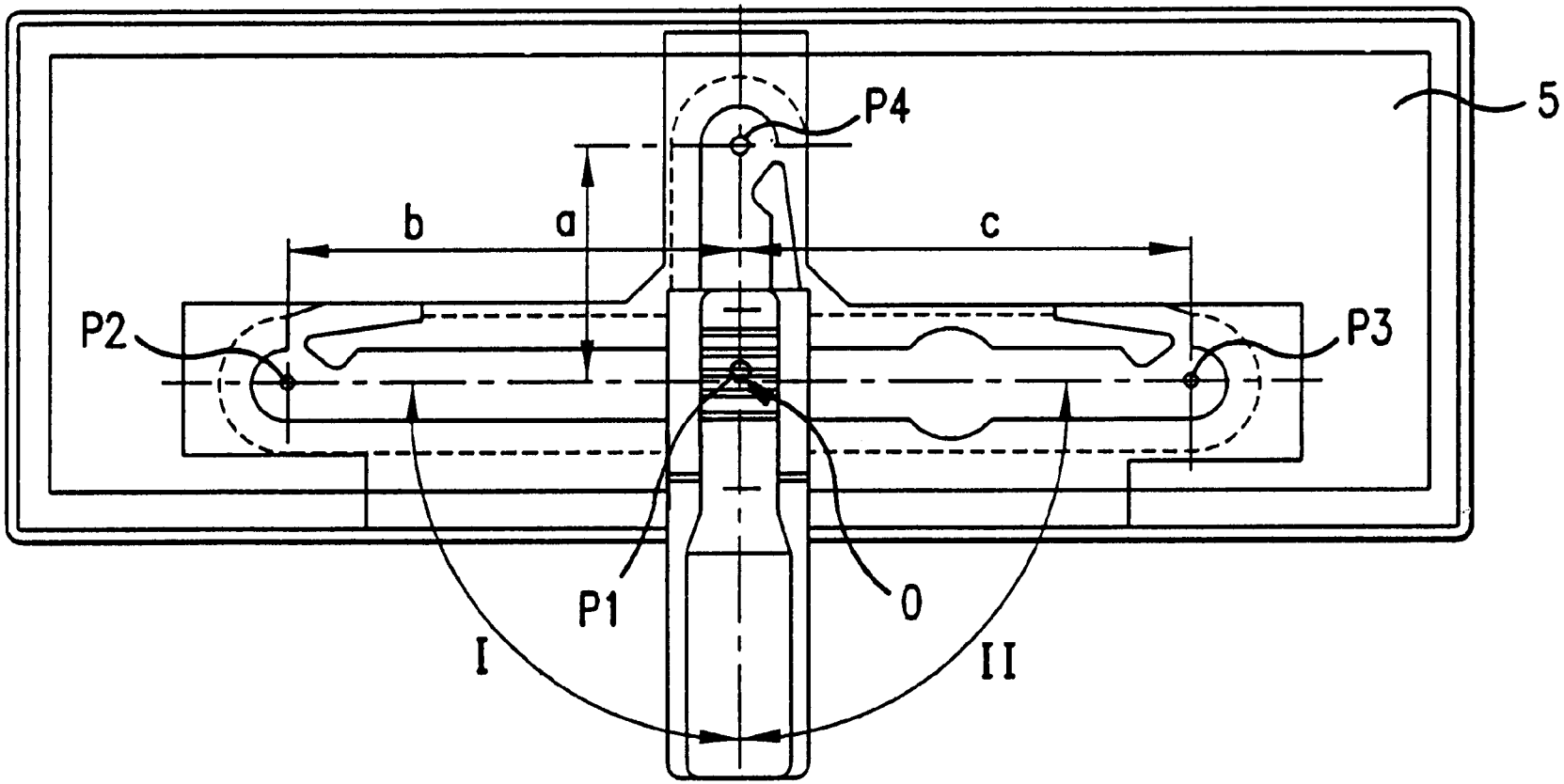
FIG. 7 is a top view of the back side of the tag according to FIGS. 1 to 6, with the clip situated in the crossing point (swivelling point) of the two guide grooves.

FIGS. 4 to 6 show the name tag according to FIGS. 1 to 3 with the clip 6 displaced into the above-mentioned second groove 10. The clip 6 can be displaced, for example, from the end position at point P2 on the left side (FIG. 1), by moving over the resilient leg 11, into the crossing point P1.

At point P1, the clip 6 and its foot part 7 and the slide 8 can be swivelled, for example, by 90°, in order to then be displaced into the position according to FIG. 5 to point P4 (with the clip opening pointing downward, being locked by the leg 13). It is also conceivable to swivel the clip in point P1 by 180° and then displace it to point P3 (locking by leg 12), in which the clip is opened toward the left.

Because of the construction described, the clip can be brought into any of positions P2, P3 or P4 and is secured there against an unintentional displacement and swivelling. These adjusting possibilities are outlined purely schematically in FIG. 7. Swivelling is possible only at crossing point P1 of the two displacement grooves 9, 10.

FIGS. 8 to 13 show another embodiment of the name tag having a fastening clip 20 constructed as a so-called "patented clip". In this case also, the name tag 22 consists of a front wall 23 with a slot 24 and a viewing window 25 as well as a rear wall 26 with two mutually crossing guide grooves 27, 28 for the foot part 29 and slide 30 of the clip 20. The foot part 29 and the slide 30 are constructed here as a horizontal "U" with a lateral opening, and, in the end positions, reach over parts 31, 32 and 33 of the groove wall. By way of cams 34 and opposite recesses 35, the foot part and the slide are locked in these positions as well as in the crossing point P1. Here also, the grooves 27, 28 have collar-shaped tabs 29 which prevent the slide 30 from jumping out of the groove.

Additionally, a swivelling of the clip 20 or the foot part 29 with the slide 30 is possible only at the crossing point P1.

Figure 8:
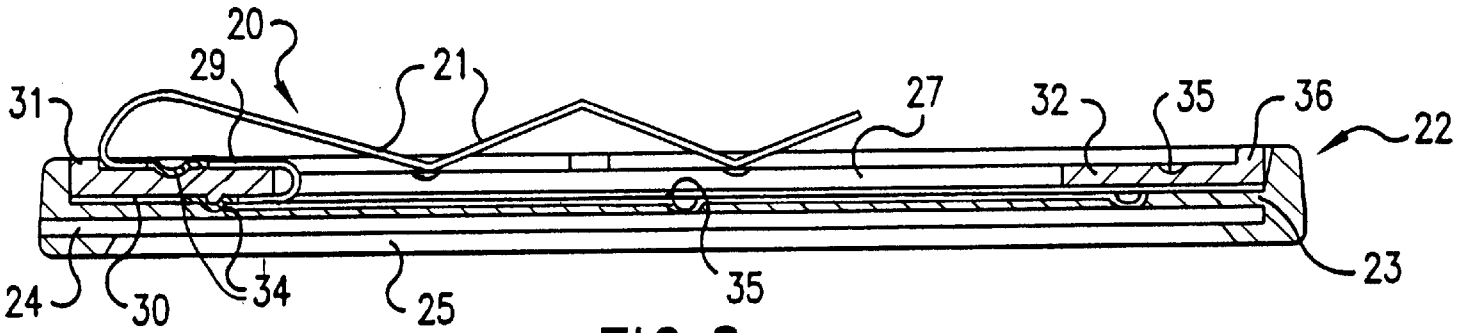
FIG. 8 is a sectional view of another embodiment of a name tag according to the invention, with the clip opening pointing to the right.
Figure 9:
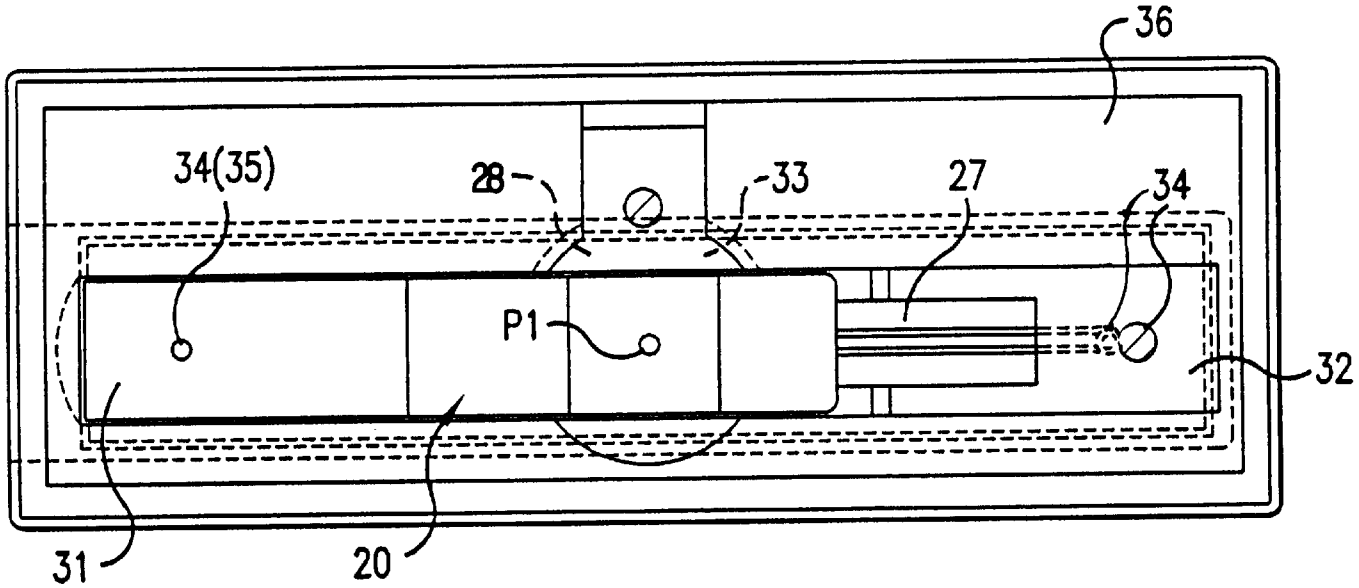
FIG. 9 is a top view of the back side of the tag according to FIG. 8.

FIGS. 8 and 9 show the clip 20 in the end position on the left side (secured against a swivelling and unintentional displacement).

Figure 10:
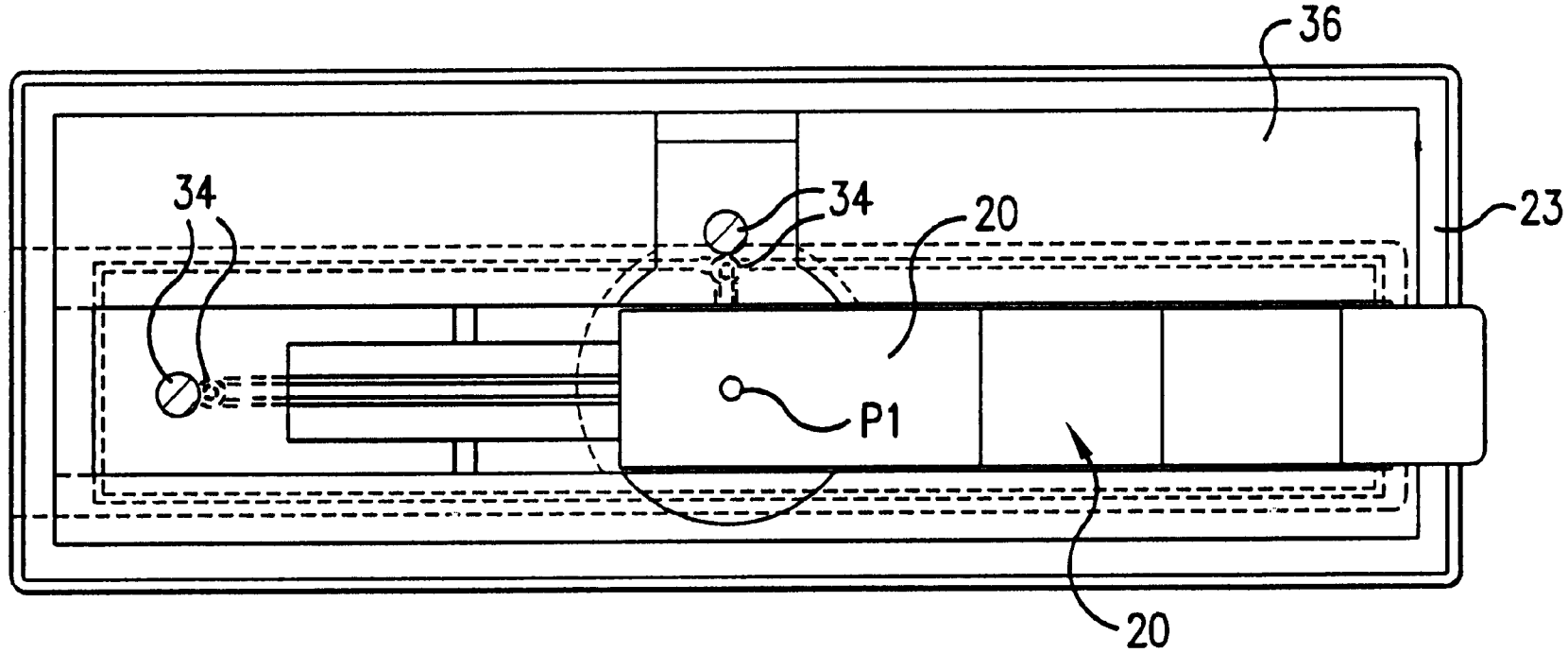
FIG. 10 is a top view similar to FIG. 9, with the clip being displaced into the groove crossing point.

FIG. 10 shows the tag rear wall 36 with the clip 20 displaced into the crossing point (opening still toward the right).

Figure 11:
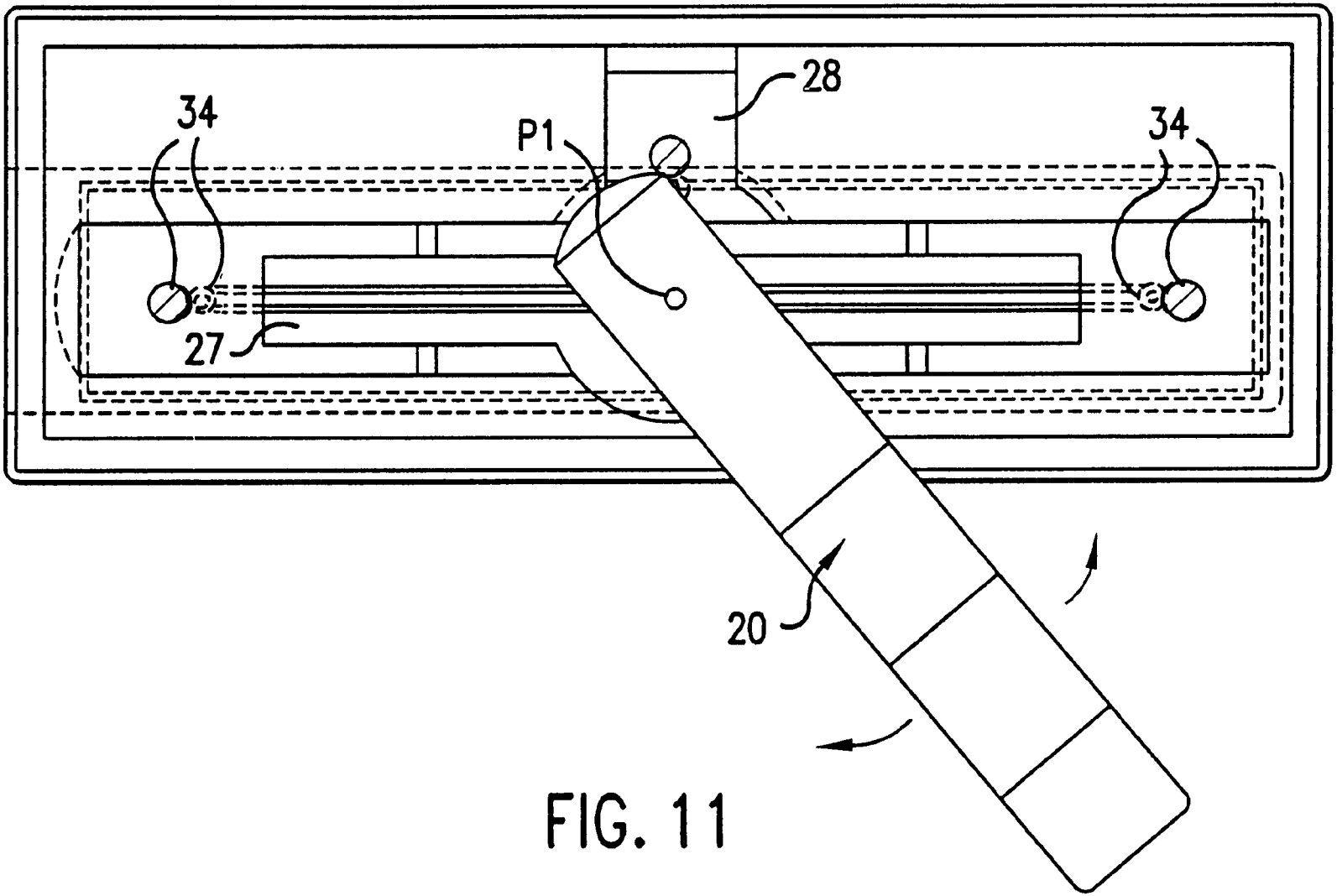
FIG. 11 is a view as in FIG. 10, with a partially swivelled clip.
Figure 12:
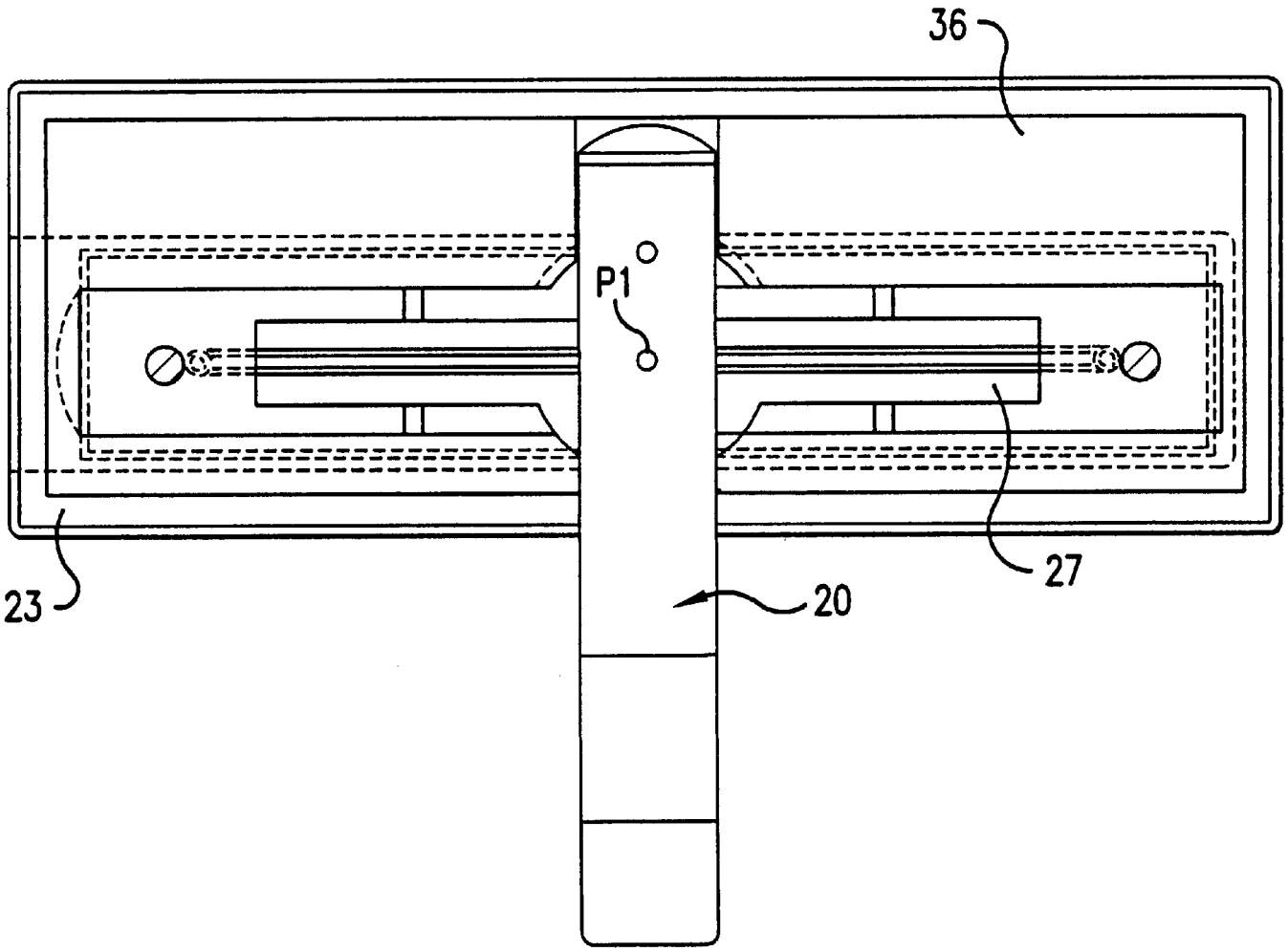
FIG. 12 is a view as in FIG. 10, with the clip swivelled by 90° and, in the branching groove, displaced into an upper end position.
Figure 13:
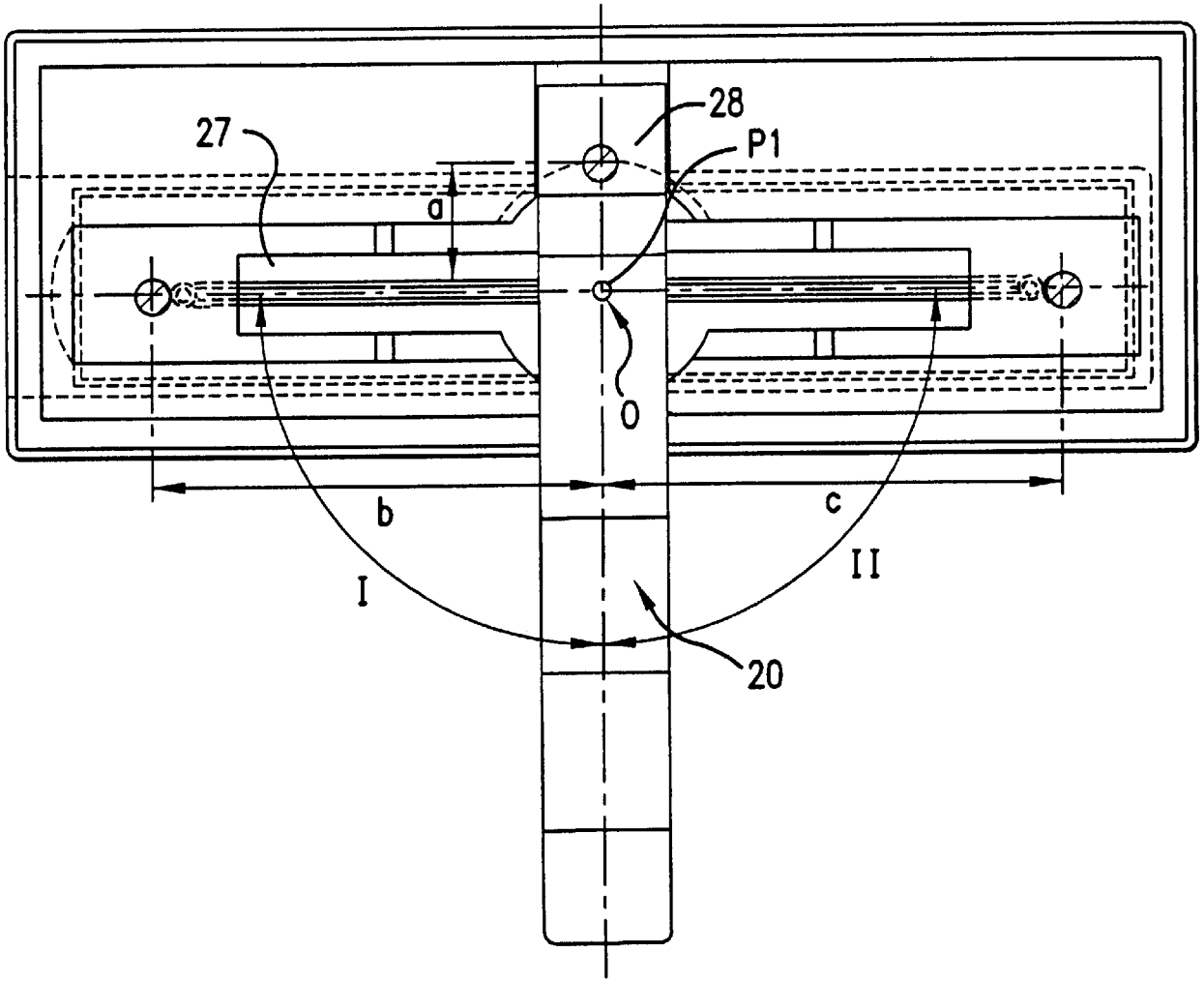
FIG. 13 is a view similar to FIG. 10, with schematically outlined swivelling and displacing possibilities of the clip.

In this position, the clip 20 can be swivelled as shown in FIG. 11 by 90°, for example. The clip can then be displaced in the groove 28 upwards into the end position illustrated in FIG. 12.

Swivelling by 180° would also be possible at the crossing point, with a subsequent displacement into the end position on the right side, with the clip opening pointing to the left (not shown).

FIG. 13 again schematically illustrates the different swivelling and displacement possibilities of the clip 20. In all end positions, the clip 20 is secured against an unintentional swivelling and displacement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Name tag comprising:

a front wall having a viewing window, a fastening clip on a rear wall, the clip having a resilient contact pressure leg and an adjoining foot part, a slide including a pin-shaped part which mounts the foot part so that the foot part can swivel relative to the rear wall, a first guide groove with which the rear wall is provided, said first guide groove extending in a first direction with respect to the rear wall, and a second guide groove with which the rear wall is also provided which branches off from the first guide groove in a second direction at a right angle with respect to said first direction, inwardly projecting collars defined in each of the guide grooves between which said pin-shaped part can slide, wherein said inwardly protecting collars secure the slide against falling out of said guide grooves and wherein said guide grooves secure the foot part against swinging out laterally with respect to the grooves except at a crossing point of the first and second guide grooves to permit swivelling of the foot part and thus of the clip through at least 90°.

2. Name tag according to claim 1, wherein the crossing point of the first and second guide grooves is situated at a longitudinal center of the first guide groove.

3. Name tag according to claim 2, wherein the first guide groove extends offset toward one side with respect to a transverse center line of the tag.

4. Name tag according to claim 2, wherein the foot part can be swivelled through 180° at said crossing point.

5. Name tag according to claim 2, and further comprising locking devices provided for locking the foot part and the slide at least in every end position in the guide grooves against an unintentional displacement.

6. Name tag according to claim 2, wherein the clip is constructed as an alligator clip with spring-type legs and the foot part.

7. Name tag according to claim 1, wherein the first guide groove extends offset toward one side with respect to a transverse center line of the tag.

8. Name tag according to claim 7, wherein the foot part can be swivelled through 180° at said crossing point.

9. Name tag according to claim 7, and further comprising locking devices provided for locking the foot part and the slide at least in every end position in the guide grooves against an unintentional displacement.

10. Name tag according to claim 7, wherein the clip is constructed as an alligator clip with spring-type legs and the foot part.

11. Name tag according to claim 1, wherein the foot part can be swivelled through 180° at said crossing point.

12. Name tag according to claim 11, and further comprising locking devices provided for locking the foot part and the slide at least in every end position in the guide grooves against an unintentional displacement.

13. Name tag according to claim 11, wherein the clip is constructed as an alligator clip with spring-type legs and the foot part.

14. Name tag according to claim 1, and further comprising locking devices provided for locking the foot part and its slide at least in every end position in the guide grooves against an unintentional displacement.

15. Name tag according to claim 14, wherein the locking devices consist of resilient tongues over which a movement can take place in both directions and which lock the slide by a lateral engagement.

16. Name tag according to claim 14, wherein the clip is constructed as an alligator clip with spring-type legs and the foot part.

17. Name tag according to claim 1, wherein the clip is constructed as an alligator clip with spring-type legs and the foot part.

18. Name tag according to claim 1, wherein the guide grooves are provided by recesses in said rear wall and wherein said rear wall can be fitted onto the front wall by snapping.

19. Name tag according to claim 1, wherein the guide grooves are provided by recesses in said rear wall and wherein said rear wall can be fitted onto the front wall by clamping.

20. Name tag according to claim 1, wherein the guide grooves are provided by recesses in said rear wall and wherein said rear wall can be fitted onto the front wall by gluing.

* * * * *